US008984715B2

(12) United States Patent
Kaji et al.

(10) Patent No.: US 8,984,715 B2
(45) Date of Patent: Mar. 24, 2015

(54) CUSHION CLIP

(75) Inventors: Atsutoshi Kaji, Toyota (JP); Makoto Kato, Toyota (JP)

(73) Assignee: Daiwa Kasei Kogyo Kabushiki Kaisha, Okazaki-shi (JP)

( * ) Notice: Subject to any disclaimer, the term of this patent is extended or adjusted under 35 U.S.C. 154(b) by 0 days.

(21) Appl. No.: 13/431,082

(22) Filed: Mar. 27, 2012

(65) Prior Publication Data

US 2012/0246896 A1 Oct. 4, 2012

(30) Foreign Application Priority Data

Mar. 31, 2011 (JP) ..... 2011-078144

(51) Int. Cl.
*E05F 5/00* (2006.01)
*E05F 5/02* (2006.01)

(52) U.S. Cl.
CPC ..... *E05F 5/022* (2013.01); *E05F 5/025* (2013.01)
USPC ..... 16/86 R; 24/458; 296/1.03; 267/141

(58) Field of Classification Search
USPC ..... 16/86 R, 85, 86 A, 82, 83; 24/458, 453; 267/220, 292, 141; 293/136; 403/14; 296/207, 220
See application file for complete search history.

(56) References Cited

U.S. PATENT DOCUMENTS

| | | | | |
|---|---|---|---|---|
| 4,522,378 | A * | 6/1985 | Nelson | 267/141.4 |
| 7,566,081 | B2 * | 7/2009 | Aoyama | 296/1.03 |
| 2011/0030177 | A1 | 2/2011 | Ukai et al. | |
| 2011/0283490 | A1 | 11/2011 | Sugiyama | |

FOREIGN PATENT DOCUMENTS

| | | | |
|---|---|---|---|
| EP | 2 306 042 | A1 | 4/2011 |
| JP | 2002-349524 | | 12/2002 |
| JP | 02008111451 | A * | 5/2008 |

* cited by examiner

*Primary Examiner* — Jack W Lavinder
(74) *Attorney, Agent, or Firm* — Christensen Fonder P.A.

(57) ABSTRACT

A cushion clip may include a support portion capable of being connected to an attachment hole formed in a first member and a cushioning portion integrally connected to the support member. The support portion has an engagement portion and a head portion. The head portion has a shoulder surface that is formed in a columnar portion thereof. The cushioning portion has a base portion that is positioned to surround the head portion. The base portion of the cushioning portion has a bulged portion that is formed therein. The bulged portion is shaped to project beyond the shoulder surface in an insertion direction of the support portion, so as to elastically contact the first member when the cushion clip is applied with the impact from a second member.

4 Claims, 10 Drawing Sheets

CUSHION CLIP

BACKGROUND OF THE INVENTION

1. Field of the Invention

The present invention relates to a cushion clip. More particularly, the present invention relates to a cushion clip that is attached to one (i.e., an attachment member) of two members capable of relatively moving toward each other in order to dampen collision between the two members and to absorb impact from the other of the two members.

2. Description of Related Art

A known cushion clip of this type is taught by, for example, Japanese Patent Number 3401242. As shown in FIG. 10, a cushion clip 101 is attached to a door frame F2 (an attachment member) of a vehicle, so as to dampen collision between the door frame F2 and a door D2 (an associated member) when the door D2 is closed. The cushion clip 101 may be integrally formed. The cushion clip 101 may include an engagement portion 110 that is capable of being inserted into an attachment hole H2 formed in the door frame F2, and a cushioning portion 120 that is configured to be projected from the door frame F2 to receive and absorb shock from the door D2. The engagement portion 110 is made of a hard resinous material having rigidity such as polypropylene. Conversely, the cushioning portion 120 is made of an elastomeric resinous material having elasticity such as silicon rubber. Thus, in the cushion clip 101, the cushioning portion 120 can elastically absorb the impact that can be produced when the door D2 is closed.

However, in the known cushion clip 101, when the cushion clip 101 is pressed by the door D2 due to vibration caused by traveling of the vehicle, the engagement portion 110 made of the hard resinous material can contact the door frame F2, thereby generating noise. Thus, there is a need in the art for an improved cushion clip.

BRIEF SUMMARY OF THE INVENTION

For example, one aspect of the present invention may provide a cushion clip that is configured to be attached to a first member of two members capable of relatively moving toward each other in order to dampen collision between the two members, which may include a support portion made of a hard material and capable of being connected to an attachment hole formed in the first member, and a cushioning portion made of a soft material and integrally connected to the support member by two-color molding. The support portion is integrally formed and has an engagement portion that is configured to be inserted into and engaged with the attachment hole, and a head portion to which the cushioning portion is integrally connected by two-color molding. The head portion has a shoulder surface that is formed in a columnar portion thereof. The shoulder surface is directed in an insertion direction of the support portion into the attachment hole. The cushioning portion is configured to project from the first member when the support portion is connected to the attachment hole, so as to elastically absorb impact from a second member. The cushioning portion has a base portion that is positioned to surround the columnar portion of the head portion. The base portion of the cushioning portion has a bulged portion that is formed in at least a portion thereof so as to extend along the columnar portion. The bulged portion is shaped to project beyond the shoulder surface in the insertion direction of the support portion, so as to elastically contact the first member when the cushion clip is applied with the impact from the second member.

According to the aspect of the invention, when the cushion clip is applied with the impact from the second member, the cushioning portion is capable of elastically receiving and absorbing the impact. At this time, the bulged portion of the cushioning portion may elastically contact the first member while the support portion cannot contact the first member. As a result, production of noise can be eliminated.

Optionally, the head portion may include an enlarged portion. The enlarged portion of the head portion may be configured to support the base portion of the cushioning portion when the impact is applied to the cushion clip from the second member, so as to prevent the base portion from excessively deforming in a direction opposite to the insertion direction of the support portion.

Other objects, features and advantages of the present invention will be readily understood after reading the following detailed description together with the accompanying drawings and the claims.

DETAILED DESCRIPTION OF THE INVENTION

Next, a representative embodiment of the present invention will be described with reference to FIGS. 1 to 9.

Figure 1:
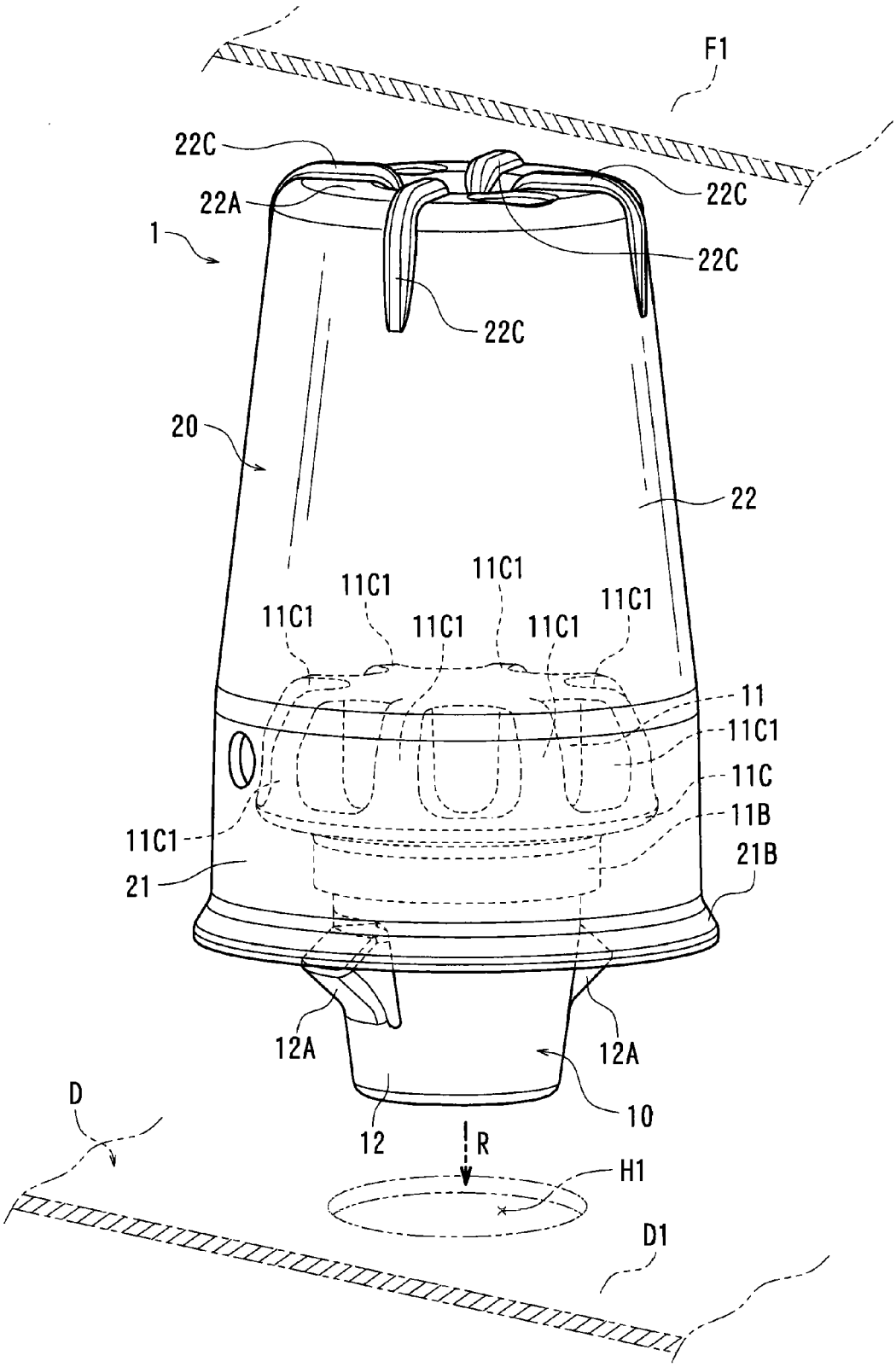
FIG. 1 is a perspective view of a cushion clip according to a representative embodiment of the present invention, in which a head portion of a support portion embedded in a cushioning portion is imaginarily shown.
Figure 7:
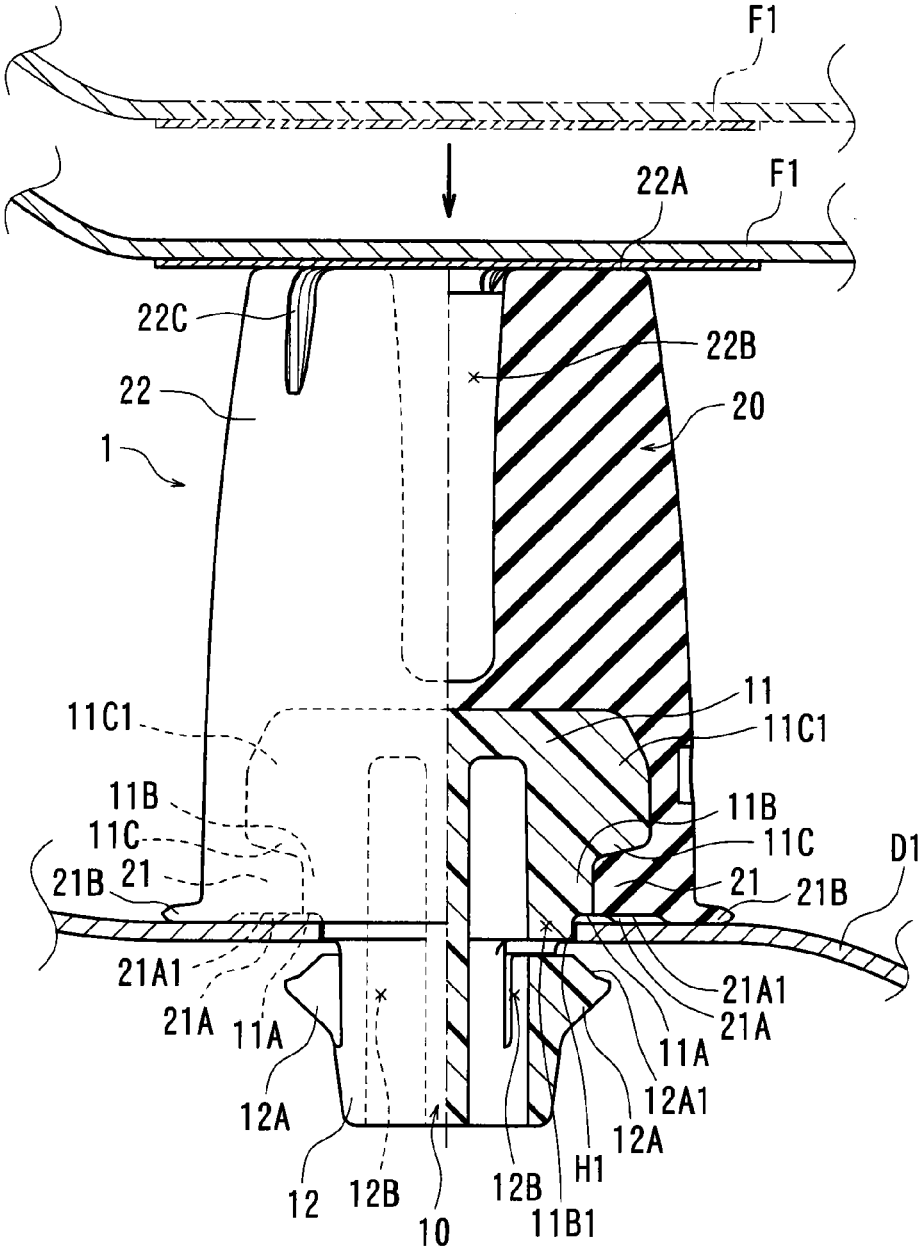
FIG. 7 is a partially longitudinal cross-sectional view of the cushion clip attached to the back door panel of the vehicle, in which the cushioning portion is elastically absorbing impact from a body panel.

As shown in FIGS. 1 and 7, a representative cushion clip 1 may be configured to be attached to a back door D (a first or attachment member) of a vehicle (not shown), so as to dampen collision between the door D and a body panel F1 (a second or associated member) when the door D is closed and to absorb impact produced therebetween. The cushion clip 1 may preferably be integrally formed. The cushion clip 1 may include a support (hard) portion 10 that is constructed to be connected to an (circular) attachment hole H1 formed in a door panel D1 of the door D, and a cushioning portion 20 that is constructed to be projected from the door panel D1 to elastically receive and absorb the impact produced between the door D and the body panel F1 when the door D is closed.

Figure 3:
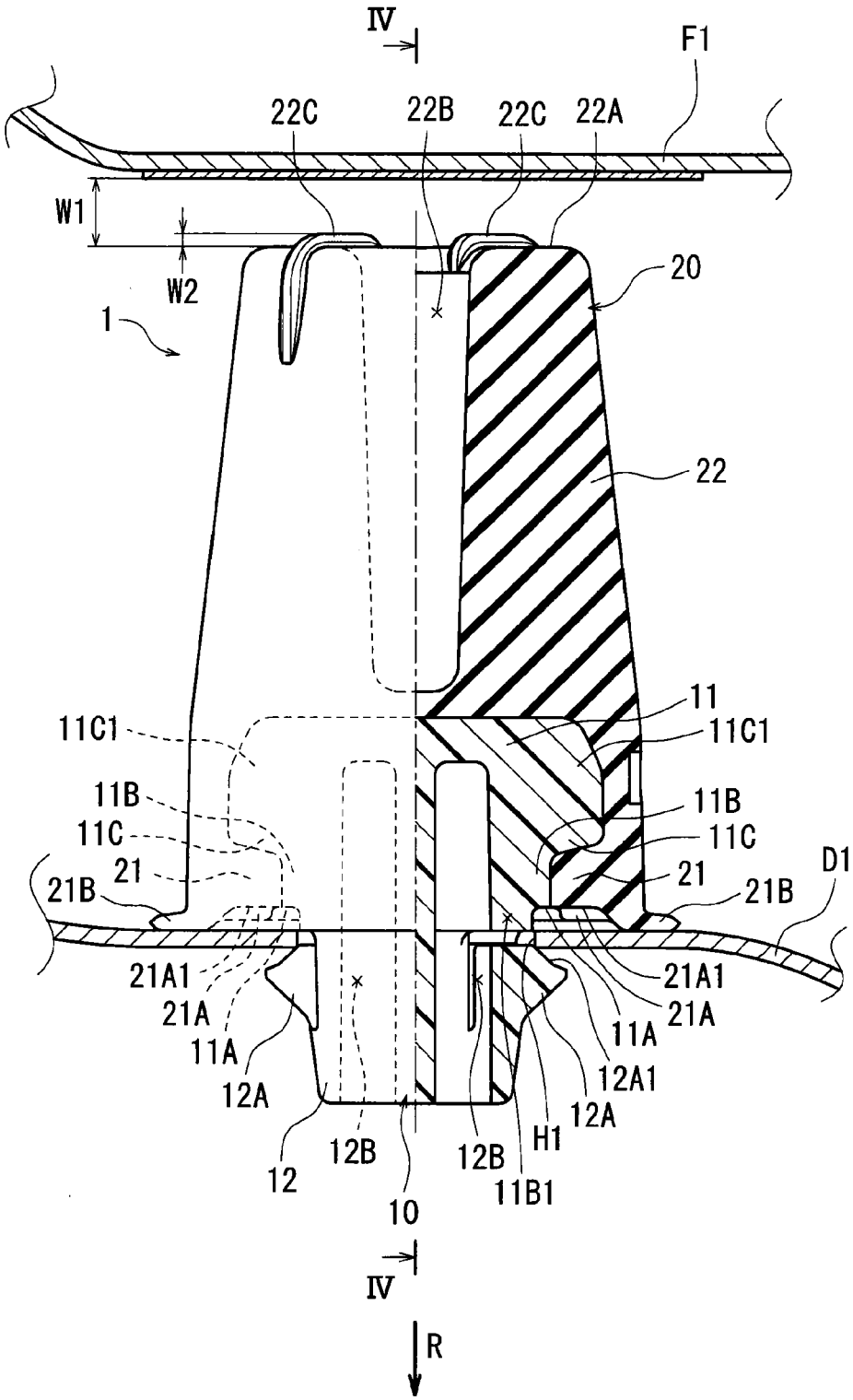
FIG. 3 is a partially longitudinal cross-sectional view of the cushion clip, in which the cushion clip is attached to a back door panel of a vehicle.

The support portion 10 may preferably be made of a hard resinous material having rigidity such as polypropylene, so as to have rigidity. In particular, as shown in FIG. 3, the support portion 10 may preferably have an (lower) engagement portion 12 and a (upper) head portion 11. The engagement portion 12 may be configured to be inserted into and engaged with the attachment hole H1. That is, the engagement portion 12 may have a diameter smaller than the diameter of the attachment hole H1, so as to be introduced thereinto. The head portion 11 may be constructed such that the cushioning portion 20 can be integrally connected thereto by two-color molding. Further, the support portion 10 thus formed may have sufficient rigidity because it is made of the hard resinous material. Therefore, the engagement portion 12 can be smoothly inserted into the attachment hole H1 of the door panel D1 in order to connect the support portion 10 thereto.

Figure 4:
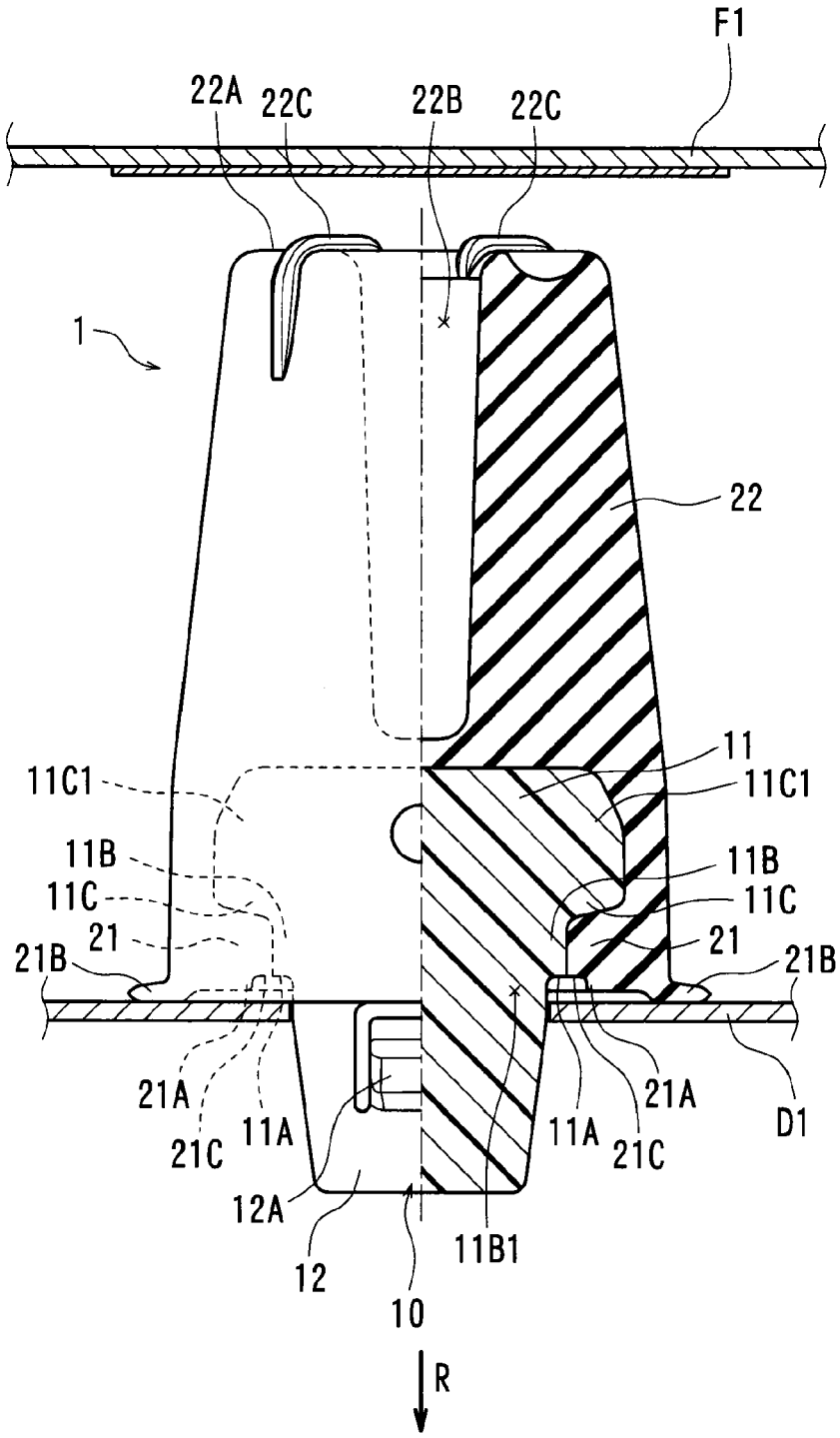
FIG. 4 is a partially cross-sectional view taken along line IV-IV in FIG. 3.

As shown in FIGS. 1, 3 and 4, the head portion 11 may preferably have a (lower) columnar portion 11B continuous with the engagement portion 12 and an (upper) enlarged portion 11C continuous with the columnar portion 11B. The columnar portion 11B has a diameter greater than a diameter of the engagement portion 12. Further, the head portion 11 may have an annular shoulder surface 11A (an annular sealing surface) that is formed in the columnar portion 11B. The shoulder surface 11A may preferably be directed in an insertion direction P of the support portion 10 into the attachment hole H1 (downward in FIGS. 1, 3 and 4), which direction may be referred to as an axially forward direction P of the support portion 10. Therefore, the shoulder surface 11A may be positioned opposite to the door panel D1 when the cushion clip 1 is attached to the back door D (the door panel D1).

Figure 2:
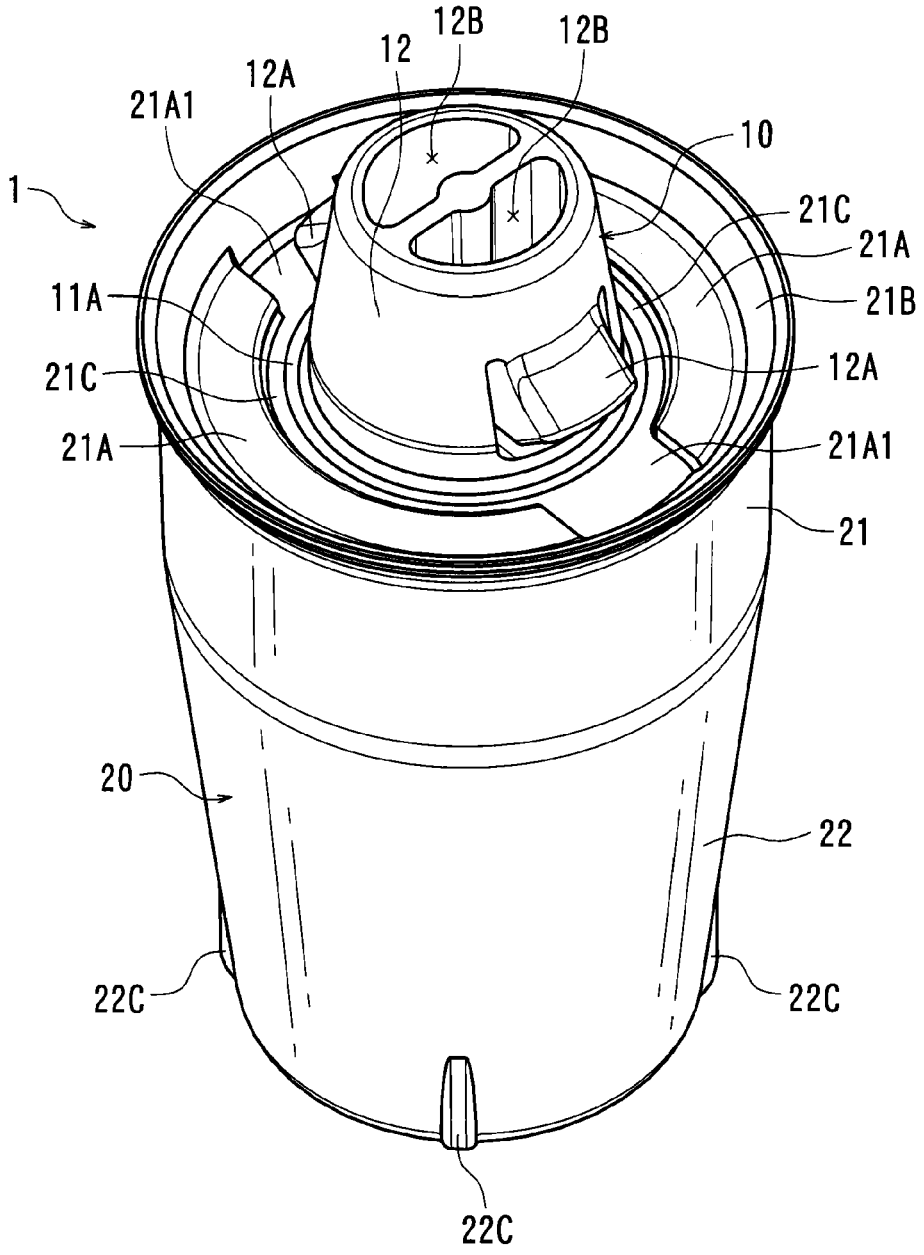
FIG. 2 is an elevational view of the cushion clip.
Figure 5:
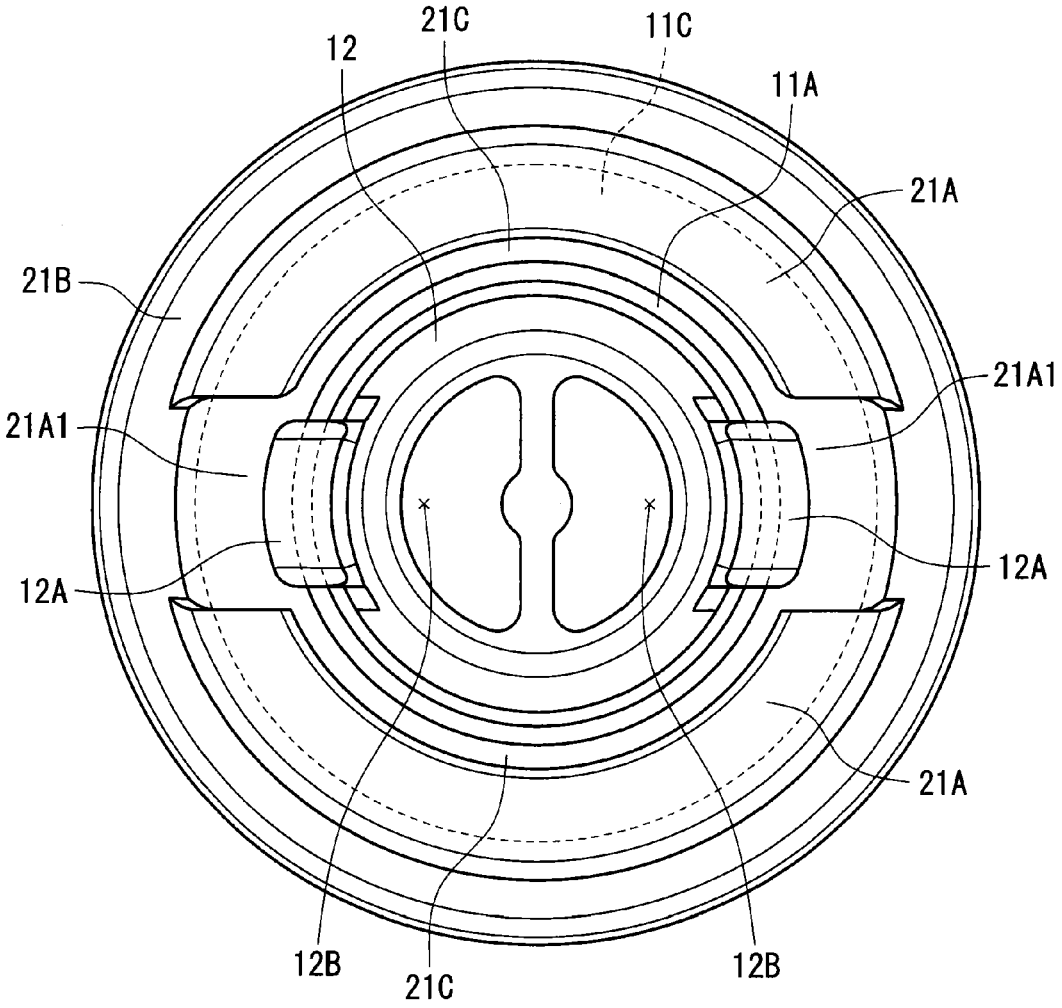
FIG. 5 is a bottom plan view of the cushion clip.

Conversely, the cushioning portion 20 is made of a soft resinous material having elasticity such as a thermoplastic elastomer, so as to have elastic deformability. The cushioning portion 20 may preferably be integrally connected to the head portion 11 of the support portion 10 by two-color molding while the head portion 11 is embedded in the cushioning portion 20. As shown in FIGS. 3 and 4, the cushioning portion 20 thus formed may have a substantially cylindrical (lower) base portion 21 surrounding the columnar portion 11B of the support portion 10 and a substantially truncated cone-shaped or frustconical (upper) main body portion 22 continuous with the base portion 21. Further, the cushioning portion 20 may have an end surface 22A (an upper end surface in FIGS. 3 and 4) that is formed in the main body portion 22. As best shown in FIG. 2, the base portion 21 may preferably have a bulged portion 21A that is circumferentially formed in a flattened bottom surface of the based portion 21, and an annular lip portion 21B that is circumferentially formed in a periphery of the bottom surface. As best shown in FIG. 5, the bulged portion 21A may be formed in a portion of the base portion 21, so as to extend along the columnar portion 11B (the shoulder surface 11A) of the support portion 10 with an annular spacing surface 21C therebetween. The bulged portion 21A may preferably be shaped to axially uniformly project (upward in FIG. 2) beyond the shoulder surface 11A in the insertion direction P of the support portion 10. Further, the bulged portion 21A may preferably have a pair of removed portions 21A1 that are positioned diametrically opposite to each other. As a result, the bulged portion 21A is substantially composed of a pair of substantially semicircular portions. Conversely, the lip portion 21B may preferably be formed to circumferentially surround the bulged portion 21A. Further, the bottom surface (the spacing surface 21C) of the based portion 21 may preferably be formed to be flush with the shoulder surface 11A of the support portion 10.

As shown in FIG. 7, when the cushion clip 1 attached to the door D is applied with the impact from the body panel F1, the cushioning portion 20 may be compressed in the insertion direction P thereof (downward in FIG. 7). Thus, an elastic force may be produced therein, so that the impact from the body panel F1 can be absorbed. In particular, when the body panel F1 relatively moves toward and contact the cushion clip 1 attached to the door D, the body panel F1 may be received by the main body portion 22 of the cushioning portion 20. As a result, the cushioning portion 20 may be elastically deformed, so that the impact from the body panel F1 can be absorbed thereby. At this time, the support portion 10 may be applied with a pressing force that presses the same into the attachment hole H1. Simultaneously, the bulged portion 21A may fully elastically contact the door panel D1. Thus, the support portion 10 (the shoulder surface 11A) may effectively be prevented from contacting the door panel D1.

In the cushion clip 1 of the present embodiment, the shoulder surface 11A of the support portion 10 is positioned opposite to the door panel D1. Therefore, when the support portion 10 (the engagement portion 12) moves toward the attachment hole H1, the shoulder surface 11A may contact the door panel D1 to produce noise unless the bulged portion 21A is formed in the cushioning portion 20. However, as described above, because the cushioning portion 20 has the bulged portion 21A, when the cushion clip 1 is applied with the impact from the body panel F1 (the door panel D1), the bulged portion 21A of the cushioning portion 20 may fully elastically contact the door panel D1. As a result, the shoulder surface 11A of the support portion 10 may be prevented from contacting the door panel D1, so that production of the noise can be eliminated.

As previously described, the head portion 11 of the support portion 10 may have the enlarged portion 11C. As shown in FIGS. 3 to 5, the enlarged portion 11C of the head portion 11 is radially enlarged, i.e., extended outwardly beyond the columnar portion 11B (the shoulder surface 11A). The enlarged portion 11C may support the base portion 21 of the cushioning portion 20 in the insertion direction P of the support portion 10 (from above in the drawings) when the impact from the body panel F1 is applied to the cushion clip 1, so as to prevent the base portion 21 from excessively deforming in a direction opposite to the insertion direction P of the support portion 10. Thus, the enlarged portion 11C of the head portion 11 may have increased support performance for supporting the base portion 21. As a result, the bulged portion 21A formed in the base portion 21 may reliably elastically contact the door panel D1 when the impact is applied to the cushion clip 1, so that the shoulder surface 11A of the support portion 10 may be reliably prevented from contacting the door panel D1. Therefore, the production of the noise can be reliably eliminated.

Figure 6:
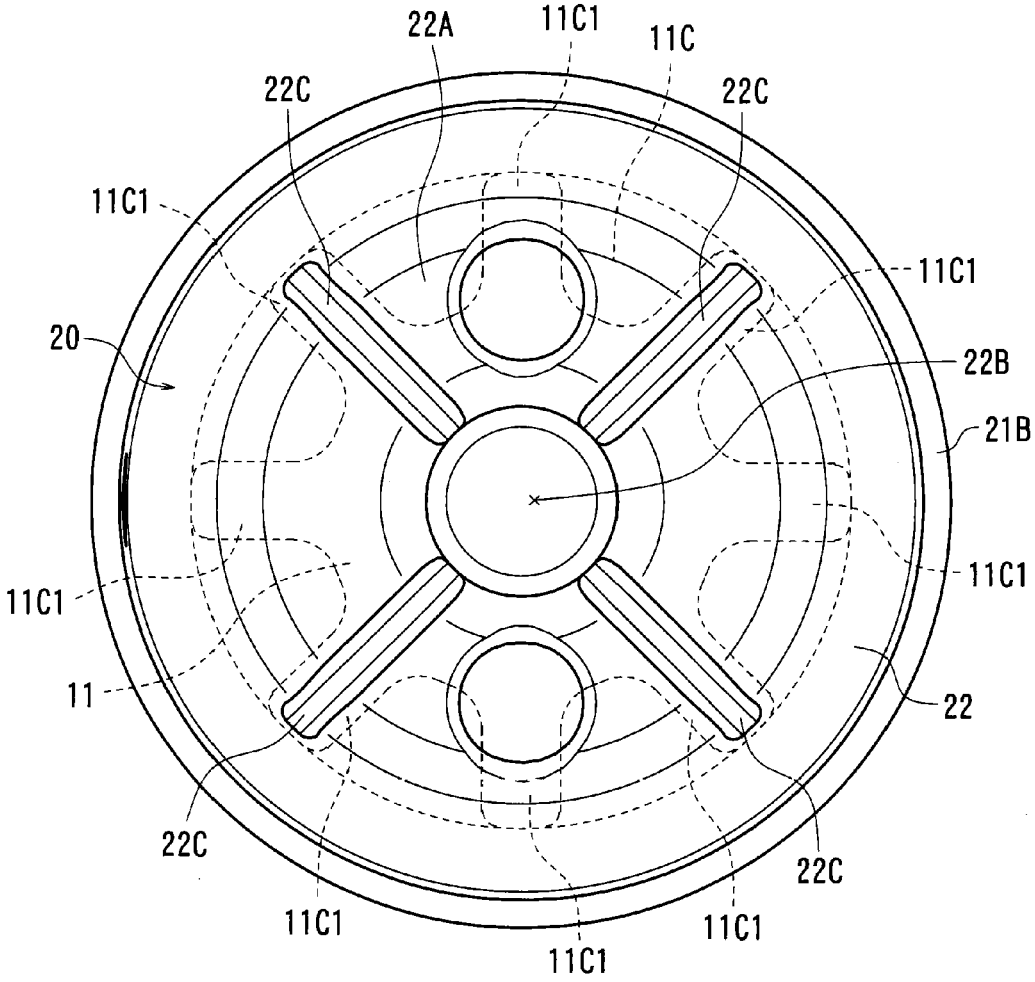
FIG. 6 is a plan view of the cushion clip.

As shown in FIGS. 1 and 6, the enlarged portion 11C of the head portion 11 has a plurality of depressed portions circumferentially formed therein, so as to form a plurality of (eight in this embodiment) ribs 11C1 therearound. Therefore, the head portion 11 (the enlarged portion 11C) may be reliably connected to or integrated with the cushioning portion 20, so as to have an increased connecting strength to the cushioning portion 20. As a result, the support performance of the enlarged portion 11C for supporting the base portion 21 can be further increased.

As shown in FIGS. 1, 3 and 4, the columnar portion 11B of the head portion 11 may have a diameter greater than a diameter of the attachment hole H1. Further, the columnar portion 11B may be formed to have a substantially uniform diameter over the entire length thereof. As shown in FIGS. 3 and 4, a lower end periphery of the columnar portion 11B (i.e., an end periphery of the columnar portion 11B in the insertion direction P of the support portion 10) may be circumferentially removed, thereby forming a thinned portion 11B1 therein.

The thinned portion 11B1 may be shaped to have a diameter smaller than the diameter of the attachment hole H1, so as to be introduced thereinto. Further, when the end periphery of the columnar portion 11B is circumferentially removed to form the thinned portion 11B1, the shoulder surface 11A of the head portion 11 may be simultaneously formed in the columnar portion 11B. Therefore, the shoulder surface 11A may have the same outer diameter as the diameter of the columnar portion 11B, which diameter is greater than the diameter of the attachment hole H1, and may have the same inner diameter as the diameter of the thinned portion 11B1, which diameter is smaller than the diameter of the attachment hole H1. Further, the shoulder surface 11A may preferably be shaped to have a flattened surface.

As shown in FIGS. 1 to 5, the engagement portion 12 may be extended from the head portion 11 (the columnar portion 11B) in the insertion direction P of the support portion 10 and may have a substantially columnar shape that is capable of being inserted into the annular attachment hole H1 formed in the door panel D1 of the door D. Further, the engagement portion 12 may have a pair of engagement strips 12A that are formed in an outer circumferential surface thereof. The engagement strips 12A may be diametrically oppositely positioned and may be constructed to be diametrically flexed relative to each other. Further, the engagement strips 12A may preferably be positioned to be diametrically aligned with the removed portions 21A1 formed in the base portion 21 of the cushioning portion 20. In addition, the engagement portion 12 may preferably have a pair of open ended hollow portions 12B that are formed therein. The hollow portions 12B may be formed to extend in a longitudinal direction of the engagement portion 12. The hollow portions 12B may preferably extend into the head portion 11, so as to continuously form bottomed hollow portions therein.

Further, as best shown in FIG. 5, the hollow portions 12B may preferably be diametrically aligned with the engagement strips 12A, so that the engagement strips 12A can be easily flexed. As will be appreciated, when the engagement portion 12 is pushed into the attachment hole H1 formed in the door panel D1 of the door D, the engagement portion 12 may be introduced into the attachment hole H1 while the engagement strips 12A are diametrically contracted by an inner circumference of the attachment hole H1. After the engagement portion 12 is substantially introduced into the attachment hole H1, the engagement strips 12A may be restored or expanded to elastically engage the inner circumference of the attachment hole H1, so that the engagement portion 12 can be connected to the attachment hole H1. Further, as shown in FIG. 3, each of the engagement strips 12A may have an inclined engagement surface 12A1, so as to reliably engage the inner circumference of the attachment hole H1 even when a thickness of the door panel D1 is changed.

As shown in FIGS. 1 and 3, the substantially frustconical (upper) main body portion 22 of the cushioning portion 20 may be formed so as to be extended from the base portion 21 in the direction opposite to the insertion direction P of the support portion 10 when the cushion clip 1 is attached to the door panel D1. As shown in FIGS. 3, 4 and 6, the main body portion 22 may preferably have a bottomed cylindrical hollow portion 22B that is formed therein. The hollow portion 22B may be formed to extend in a longitudinal direction of the main body portion 22. The hollow portion 22B may preferably be opened in the end surface 22A of the main body portion 22 (the cushioning portion 20). Further, as best shown in FIG. 6, the main body portion 22 may preferably have a plurality (four in this embodiment) of ribs 22C. The ribs 22C are radially formed in the end surface 22A of the main body portion 22 while being partially hanged over a circumferential surface of the main body portion 22.

As will be recognized, the bottomed hollow portion 22B formed in the main body portion 22 may function to change elastic deformability or elastic force of the main body portion 22. Therefore, it is possible to change the elastic force of the main body portion 22 by changing a size of the hollow portion 22B. Conversely, as shown in FIG. 3, each of the ribs 22C of the main body portion 22 may preferably have a height W2. Therefore, when the body panel F1 collides the cushion clip 1 attached to the door D, the ribs 22C may contact the body panel F1 before the end surface 22A of the main body portion 22 contacts the body panel F1, so that the main body portion 22 can gently absorb the impact.

As shown in FIGS. 3 and 4, the cushion clip 1 is arranged and constructed such that the main body portion 22 cannot contact the body panel F1 when a relation between the door D and the body panel F1 is in a normal condition, i.e., when the door D is being closed. In particular, the cushion clip 1 is arranged and constructed such that the end surface 22A of the main body portion 22 can be positioned opposite to the body panel F1 with a clearance W1 that is greater than the height W2 of each of the ribs 22C when the door D is being closed. Thus, in the normal condition, the cushion clip 1 (the main body portion 22) can be prevented from being pressed by the body panel F1.

The bulged portion 21A of the base portion 21 may preferably be shaped to have a flattened surface. Thus, when the impact from the body panel F1 is applied to the cushion clip 1 attached to the door D, the bulged portion 21A can reliably contact the door panel D1, so as to produce the elastic force that is capable of effectively absorb the impact.

As best shown in FIG. 1, the lip portion 21B of the base portion 21 may preferably be formed in the periphery of the bottom surface of the base portion 21, so as to be flared in the insertion direction P of the support portion 10 (downwardly in FIG. 1). As shown in FIGS. 3 and 4, the lip portion 21B thus shaped may be elastically flexed to closely contact a surface of the door panel D1 of the door D when the engagement portion 12 of the support portion 10 is inserted into the attachment hole H1 formed in the door panel D1, so as to prevent rainwater, dust or other such materials from entering the door D through the attaching hole H1.

A representative method for manufacturing the cushion clip 1 will now be described with reference to FIGS. 2 to 10. In this embodiment, the cushion clip 1 may preferably be manufacture by two-color molding. That is, the support portion 10 may be formed (a primary molding process). Thereafter, the cushioning portion 20 may be integrally formed on the support portion 10 (a secondary molding process), thereby producing the cushion clip 1.

Figure 8:
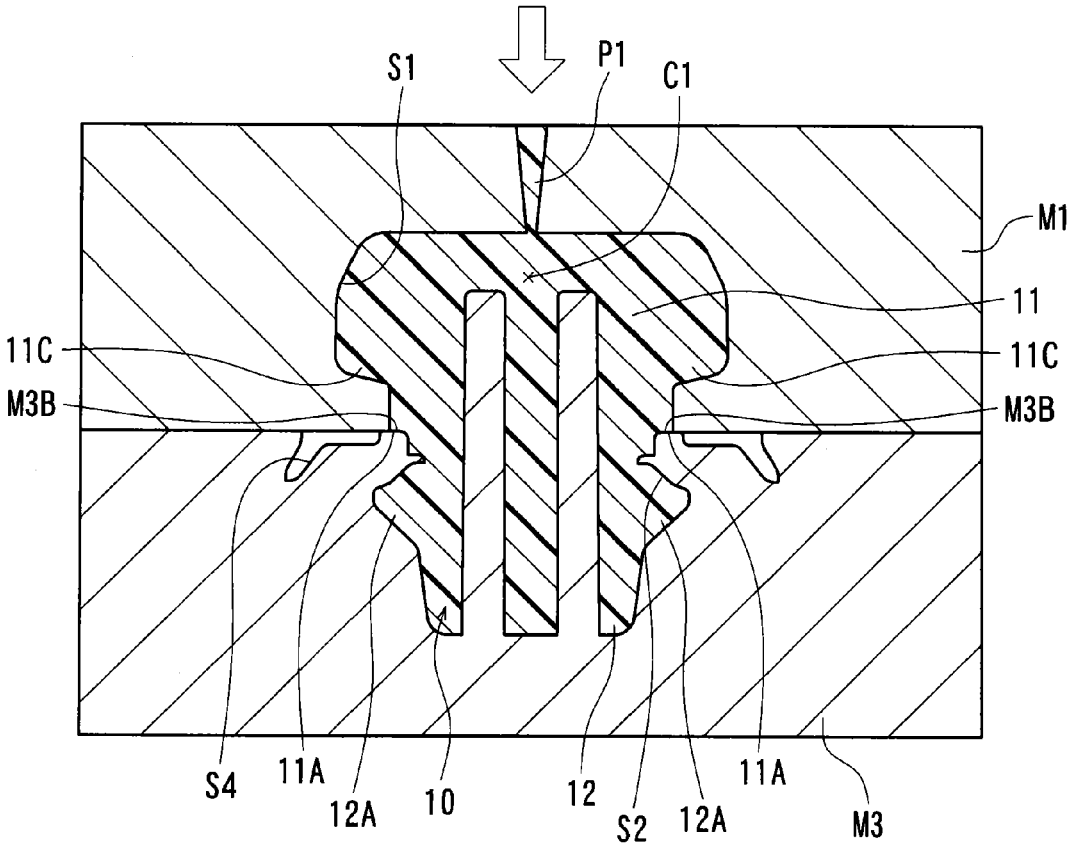
FIG. 8 is an explanatory view of a primary molding process, which view illustrates a condition in which the support portion is molded.

First, as shown in FIG. 8, a first upper die element M1 (a primary molding die element) may be disposed on a lower die element M3 (a common molding die element), so as to from a first molding cavity C1 between a molding surface S1 of the first upper die element M1 and a first molding surface S2 of the lower die element M3 (a primary die closing step). Thereafter, a first molding material P1 (i.e., the hard resinous material such as polypropylene) may be fed into the first molding cavity C1, thereby forming the support portion 10 (a primary molding step). After the primary molding step is completed, the first upper die element M1 may be removed from the lower die element M3 (a primary die-opening step).

Figure 9:
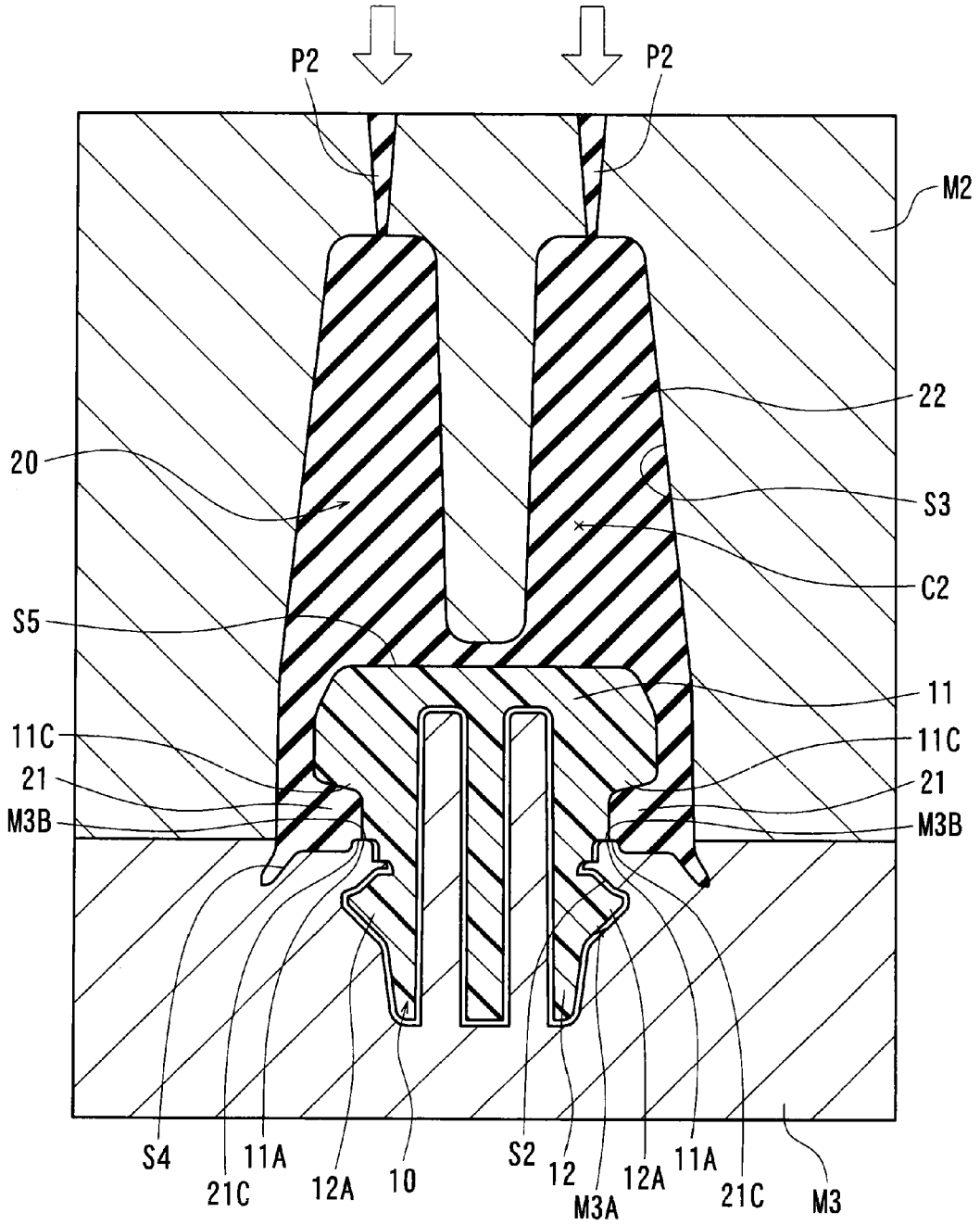
FIG. 9 is an explanatory view of a secondary molding process, which view illustrates a condition in which the cushioning portion is integrally molded on the support portion.
Figure 10:
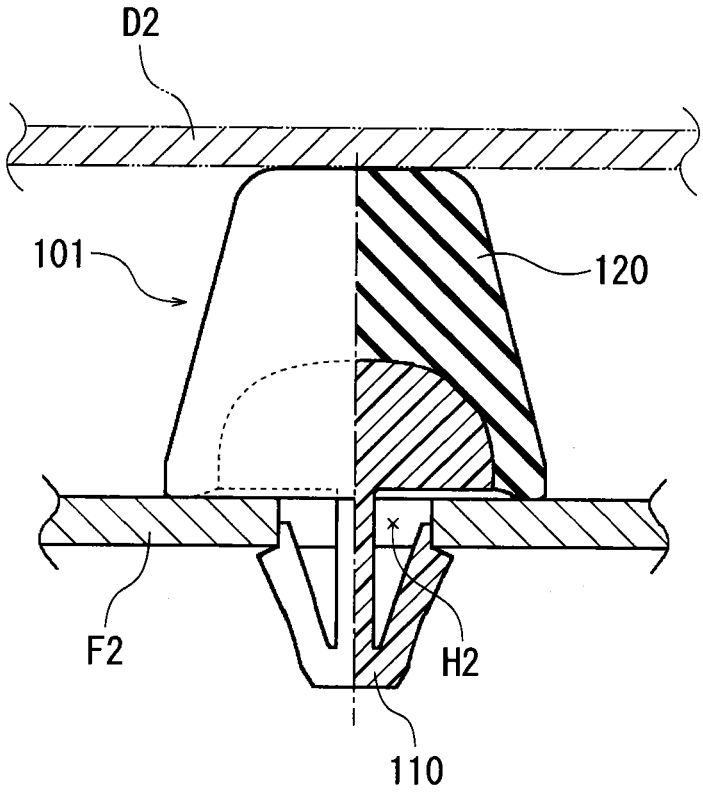
FIG. 10 PRIOR ART
FIG. 10 is a partially longitudinal cross-sectional view of a conventional cushion clip, in which the cushion clip is attached to a door frame of a vehicle.

Subsequently, as shown in FIG. 9, a second upper die element M2 (a secondary molding die element) may be disposed on the lower die element M3 with leaving the formed support portion 10 on the lower die element M3, so as to from a second molding cavity C2 among a molding surface S3 of the second upper die element M2, a second molding surface S4 of the lower die element M3 and an outer surface S5 of the support portion 10 (a secondary die closing step). Thereafter, a second molding material P2 (i.e., the soft resinous material such as the thermoplastic elastomer) may be fed into the second molding cavity C2, thereby integrally forming the cushioning portion 20 on the head portion 11 of the support portion 10 (a secondary molding step). Thus, the cushion clip 1 may be formed. After the secondary molding step is completed, the second upper die element M2 may be removed from the lower die element M3 (a secondary die-opening step), so that the cushion clip 1 can be removed from the lower die element M3.

The first upper die element M1 may preferably be composed of a plurality of slide die parts (not shown) that are capable of radially moving or sliding. Therefore, in the primary die-opening step, the first upper die element M1 can be easily removed from the support portion 10 (the head portion 11) although the head portion 11 has an undercut (e.g., the enlarged portion 11C). Similarly, the lower die element M3 may preferably be composed of a plurality of slide die parts (not shown) that are capable of radially moving or sliding. Therefore, in the secondary die-opening step, the lower die element M3 can be easily released from the support portion 10 (the engagement portion 12) although the engagement portion 12 has an undercut (e.g., the engagement strips 12A).

Further, the support portion 10 formed in the first molding cavity C1 may be shrunk with time, so as to be reduced in size. That is, as shown in FIG. 9, a clearance M3A may be formed between the first molding surface S2 of the lower die element M3 and the outer surface S5 of the support portion 10 by shrinking of the support portion 10. Therefore, the molding surface S1 of the first upper die element M1 and the first molding surface S2 of the lower die element M3 may preferably be shaped such that the first molding cavity C1 formed therebetween can have a size greater than a predetermined size of the support portion 10 in consideration of a shrinkage of the support portion 10.

As shown in FIG. 8, in the primary molding step, the head portion 11 of the support portion 10 may be molded only by the molding surface S1 of the first upper die element M1 while the engagement portion 12 of the support portion 10 may be molded only by the first molding surface S2 of the lower die element M3. As a result, when the first upper die element M1 is removed from the lower die element M3, the support portion 10 can be left on the lower die element M3 while only the head portion 11 thereof is projected from the lower die element M3. Therefore, in the secondary molding step, the cushioning portion 20 can be integrally molded on the support portion 10 while only the head portion 11 is embedded therein.

As shown in FIG. 8, in the primary molding step, the shoulder surface 11A of the head portion 11 may be formed by an annular flat molding surface M3B formed in the lower die element M3. Conversely, as shown in FIG. 9, in the secondary molding step, the annular molding surface M3B may function to form the annular spacing surface 21C of the based portion 21 of the cushioning portion 20. Therefore, the annular molding surface M3B may have a width greater than a width of the shoulder surface 11A of the head portion 11. As a result, in the primary molding step, the annular molding surface M3B may function as a sealing surface between the first upper die element M1 and the lower die element M3, so that the first molding material P1 can be prevented from being leaked out of the first molding cavity C1.

To the contrary, as shown in FIG. 9, in the secondary molding step, the annular molding surface M3B may function as a sealing surface between the support portion 10 and the lower die element M3. That is, the annular molding surface M3B may closely contact the shoulder surface 11A of the head portion 11, so that the second molding cavity C2 can be separated from the clearance M3A formed between the lower die element M3 and the support portion 10. Therefore, the second molding material P2 can be prevented from being leaked out of the second molding cavity C2 and entering the clearance M3A formed in the lower die element M3. Further, the annular molding surface M3B may contact the shoulder surface 11A of the head portion 11 by plane contact, so that the second molding cavity C2 can be reliably separated from the clearance M3A even when the support portion 10 is shrunk.

Next, a method of using the cushion clip 1 will now be described.

First, as shown in FIG. 1, in order to attach the cushion clip 1 to the door panel D1 of the door D, the engagement portion 12 of the support portion 10 may be pushed into the attachment hole H1 formed in the door panel D1. As a result, the engagement portion 12 may be inserted into the attachment hole H1 while the engagement strips 12A are diametrically inwardly contracted by the inner circumference of the attachment hole H1. As shown in FIGS. 3 and 4, upon insertion of the engagement portion 12, the engagement strips 12A may be restored or expanded to elastically engage the inner circumference of the attachment hole H1, so that the engagement portion 12 (the support portion 10) can be connected to the attachment hole H1. Thus, the cushion clip 1 can be attached to the door panel D1.

At this time, as shown in FIGS. 3 and 4, the lip portion 21B of the cushioning portion 20 (the base portion 21) can be elastically flexed to closely contact the surface of the door panel D1 while the bulged portion 21A of the cushioning portion 20 is positioned opposite to the surface of the door panel D1 with a space.

According to the cushion clip 1 of the present invention, as shown in FIG. 7, when the cushion clip 1 attached to the door panel D1 is applied with the impact from the body panel F1, the cushioning portion 20 can be compressed axially. At this time, the bulged portion 21A of the cushioning portion 20 may fully elastically contact the door panel D1, so as to prevent the shoulder surface 11A of the support portion 10 from contacting the door panel D1. As a result, production of the noise can be eliminated.

Further, when the impact is applied to the cushion clip 1 from the body panel F1, the ribs 22C formed in the main body portion 22 of the cushioning portion 20 may contact the body panel F1 before the end surface 22A of the main body portion 22 contacts the body panel F1, so that the impact can be gently absorbed by the main body portion 22.

Naturally, various changes and modifications may be made to the present invention without departing from the scope of the invention. For example, an engagement structure of the engagement portion 12 of the support portion 10 and the attachment hole H1 can be changed as necessary. Further, the enlarged portion 11C of the support portion 10 (the head portion 11) can be modified in shape and size. For example, the ribs 11C1 formed in the enlarged portion 11C can be omitted. Further, the enlarged portion 11C can have circumferentially discontinuous portions that are formed therein. In addition, the enlarged portion 11C can be omitted as necessary. Further, the shoulder surface 11A of the head portion 11 can be shaped to be inclined.

Further, in the embodiment, polypropylene is exemplified as the hard resinous material. However, the hard resinous material may include polyacetal (e.g., polyoxymethylene (POM)), nylon, polybutyleneterephthalate, polyethylene and PC/ABS alloys. That is, the support portion 10 can be made of various materials having suitable rigidity provided that they are suitable for the primary molding process in the two-color molding.

Further, in the embodiment, the thermoplastic elastomer is exemplified as the soft resinous material. However, the soft resinous material may include polyvinyl chloride, silicon rubber and rubber. That is, the cushioning portion 20 can be made of various materials having suitable elasticity provided that they are suitable for the secondary molding process in the two-color molding.

Further, a construction of the main body portion 22 of the cushioning portion 20 can be changed as necessary. Further, the annular lip portion 21B of the cushioning portion 20 (the base portion 21) can be modified in shape and size. Further, the annular lip portion 21B can be omitted as necessary.

In this embodiment, the bulged portion 21A of the cushioning portion 20 is formed as a pair of substantially semicircular portions that extend along the shoulder surface 11A (the columnar portion 11B) of the support portion 10 and that uniformly project from the bottom surface of the based portion 21 beyond the shoulder surface 11A. However, the bulged portion 21A can be formed as a plurality of projections that are discontinuously formed in the base portion 21 to be positioned along the shoulder surface 11A. Also, the bulged portion 21A can be formed as an annular projection that is continuously formed in the base portion 21 to be positioned along the shoulder surface 11A. That is, the removed portions 21A1 formed in the bulged portion 21A can be omitted. Further, the bulged portion 21A can be formed in the base portion 21 such that the spacing surface 21C cannot be formed between the bulged portion 21A and the shoulder surface 11A.

In this embodiment, as shown in FIGS. 1 and 7, the cushion clip 1 is attached to the door panel D1 (a movable member) of the back door D of the vehicle, so as to dampen the collision between the door panel D1 and the body panel F1 (a stationary member) when the door D is closed or when vibration caused by traveling of the vehicle is generated. However, the present invention can be applied to a cushion clip that is attached to one of various types of two members capable of relatively moving toward each other in order to dampen the collision therebetween. A door and a door frame of a vehicle can be exemplified as the two members. Further, the cushion clip can be attached to either of the two members.

A representative example of the present invention has been described in detail with reference to the attached drawings. This detailed description is merely intended to teach a person of skill in the art further details for practicing preferred aspects of the present invention and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present invention.

What is claimed is:

1. A cushion clip that is configured to be attached to a first member of two members capable of relatively moving toward each other in order to dampen collision between the two members; comprising:

a support portion made of a hard material and capable of being connected to an attachment hole formed in the first member; and a cushioning portion made of a soft material and integrally connected to the support member by two-color molding, wherein the support portion is integrally formed and has an engagement portion that is configured to be inserted into and engaged with the attachment hole, and a head portion to which the cushioning portion is integrally connected by two-color molding, wherein the head portion has a shoulder surface that is formed in a columnar portion thereof and extending continuously about a circumference of the columnar portion, the shoulder surface being directed in an insertion direction of the support portion into the attachment hole, wherein the cushioning portion is configured to project from the first member when the support portion is connected to the attachment hole, so as to elastically absorb impact from a second member, wherein the cushioning portion has a base portion that is positioned to surround the columnar portion of the head portion, wherein the base portion of the cushioning portion has a bulged portion that is circumferentially formed in at least a portion thereof so as to circumferentially extend along the shoulder surface formed in the columnar portion, the bulged portion being shaped to project beyond the shoulder surface in the insertion direction of the support portion, so as to elastically contact the first member to prevent the shoulder surface from contacting the first member when the cushion clip is applied with the impact from the second member and, wherein the base portion of the cushioning portion has a lip portion that is circumferentially formed therein so as to circumferentially surround the bulged portion, and wherein the lip portion has a height greater than the bulged portion in the insertion direction of the support portion.

2. The cushion clip as defined in claim 1, wherein the head portion comprises an enlarged portion, and wherein the enlarged portion of the head portion is configured to support the base portion of the cushioning portion when the impact is applied to the cushion clip from the second member, so as to prevent the base portion from excessively deforming in a direction opposite to the insertion direction of the support portion.

3. The cushion clip as defined in claim 1, wherein the lip portion is configured to closely contact the first member when the support portion is connected to the attachment hole.

4. The cushion clip as defined in claim 1, wherein the bulged portion is composed of a pair of semicircular portions that are circumferentially spaced from each other.

* * * * *